US005267927A

United States Patent [19]

Catanzano et al.

[11] Patent Number: 5,267,927

[45] Date of Patent: Dec. 7, 1993

[54] EXERCISE SHOE WITH NESTED WEIGHT MODULES

[76] Inventors: Michael A. Catanzano, 418 High Pkwy.; Anthony Wolverton, 14835 W. 49th Ave., both of Golden, Colo. 80403

[21] Appl. No.: 931,971

[22] Filed: Aug. 19, 1992

[51] Int. Cl.[5] ..... A63B 21/00

[52] U.S. Cl. ..... 482/105; 482/79; 482/93

[58] Field of Search ..... 482/79, 80, 105, 148, 482/907, 93, 106; 280/612

[56] References Cited

U.S. PATENT DOCUMENTS

| | | | |
|---|---|---|---|
| 2,114,790 | 4/1938 | Venables | 482/79 |
| 2,214,052 | 9/1940 | Good | 482/105 |
| 3,501,144 | 3/1970 | Schmidt | 482/105 |
| 3,517,928 | 6/1970 | Shanahan | 482/79 |
| 3,927,897 | 12/1975 | Olson et al. | 280/612 |
| 3,960,383 | 6/1976 | O'Neil | 280/612 |
| 4,159,111 | 6/1979 | Lowth | 482/80 |

FOREIGN PATENT DOCUMENTS

| | | | |
|---|---|---|---|
| 3436554 | 4/1986 | Fed. Rep. of Germany | 482/79 |
| 2575074 | 6/1986 | France | 482/79 |
| 0609109 | 9/1948 | United Kingdom | 482/80 |

OTHER PUBLICATIONS

Article: "The Healing Power of Rock and Roll" by Kelli Anderson, Sports Illustrated Jun. 17, 1991 p. 9.

*Primary Examiner*—Robert Bahr
*Assistant Examiner*—Jeanne M. Mollo
*Attorney, Agent, or Firm*—S. Michael Bender

[57] ABSTRACT

An exercising device in the form of a shoe having a series of weighted sections adapted to be added or removed so as to selectively vary the weight of the shoe. The weighted sections have cooperating joinder elements which enable them to be nested longitudinally with respect to each other in a cantilevered fashion and then locked in place. A rounded heel section is provided to facilitate exercises comprising rocking movements of the foot. In an alternative embodiment, a cooperating platform shoe member is provided for attaching to the device so that ambulation is facilitated without requiring removal of the exercising device.

10 Claims, 4 Drawing Sheets

5267927

EXERCISE SHOE WITH NESTED WEIGHT MODULES

BACKGROUND OF THE INVENTION

1. Field of the Invention

The present invention relates generally to exercising devices, and more particularly, to an exercising device in the general form of a shoe worn on the lower extremity of an individual.

2. Description of the Prior Art

Exercising devices in the form of a weighted shoe or appliance adapted to be fitted on the lower extremity of an individual are known. Examples of such devices are disclosed in the following U.S. Pat. Nos.: 4,322,072 (multiple pocket leg weight); 4,777,743 (athletic shoe with weight sewn in ankle top); 4,896,879 (container fillable with a liquid adapted to be strapped to the foot); 3,517,928 (shoe having compartments in sole each housing a separate weight); and 4,572,505 (an inclined foot rest with weighted frame).

Thus, while the foregoing body of prior art indicates it generally to be old to use a weighted device attachable to an individual's foot for enabling exercising movements resisted by weight, the provision of an exercising apparatus having means for conveniently selectively adjusting the weights thereon and for providing the flexibility of affording a variety of different exercises in a single integrated device is not contemplated. Nor does the prior art described above teach or suggest exercising device whose character may be modified by an adaptor and without removing the device. The foregoing disadvantages are overcome by the unique exercising device of the present invention as will be made apparent from the following description thereof. Other advantages of the present invention over the prior art also will be rendered evident.

SUMMARY OF THE INVENTION

To achieve the foregoing and other advantages, the present invention, briefly described, provides an exercising device in the form of a shoe having a series of weighted sections adapted to be added or removed so as to selectively vary the weight of the shoe. The weighted sections have means which enable them to be nested longitudinally with respect to each other in a cantilevered fashion and then locked in place. A rounded heel section is provided to facilitate exercises comprising rocking movement of the foot. In an alternative embodiment, cooperating platform shoe means are provided for attaching to the device so that ambulation is facilitated without requiring removal of the exercising device.

It is therefore an object of the present invention to provide a new and improved exercising device which has all of the advantages of the prior art and none of the disadvantages.

It is another object of the present invention to provide a new an improved exercising device which may be easily and efficiently manufactured and marketed.

It is a further objective of the present invention to provide a new and improved exercising device of inexpensive and reliable construction.

Still yet a further object of the present invention is to provide a new and improved exercising device having selectively removable weight means attached to a shoe-like support member.

It is still a further object of the present invention is to provide a new and improved exercising device having adaptor means associated therewith to facilitate ambulation without requiring removal of the device.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved exercising device embodying the principles and concepts of the present invention will be described.

Figure 1:
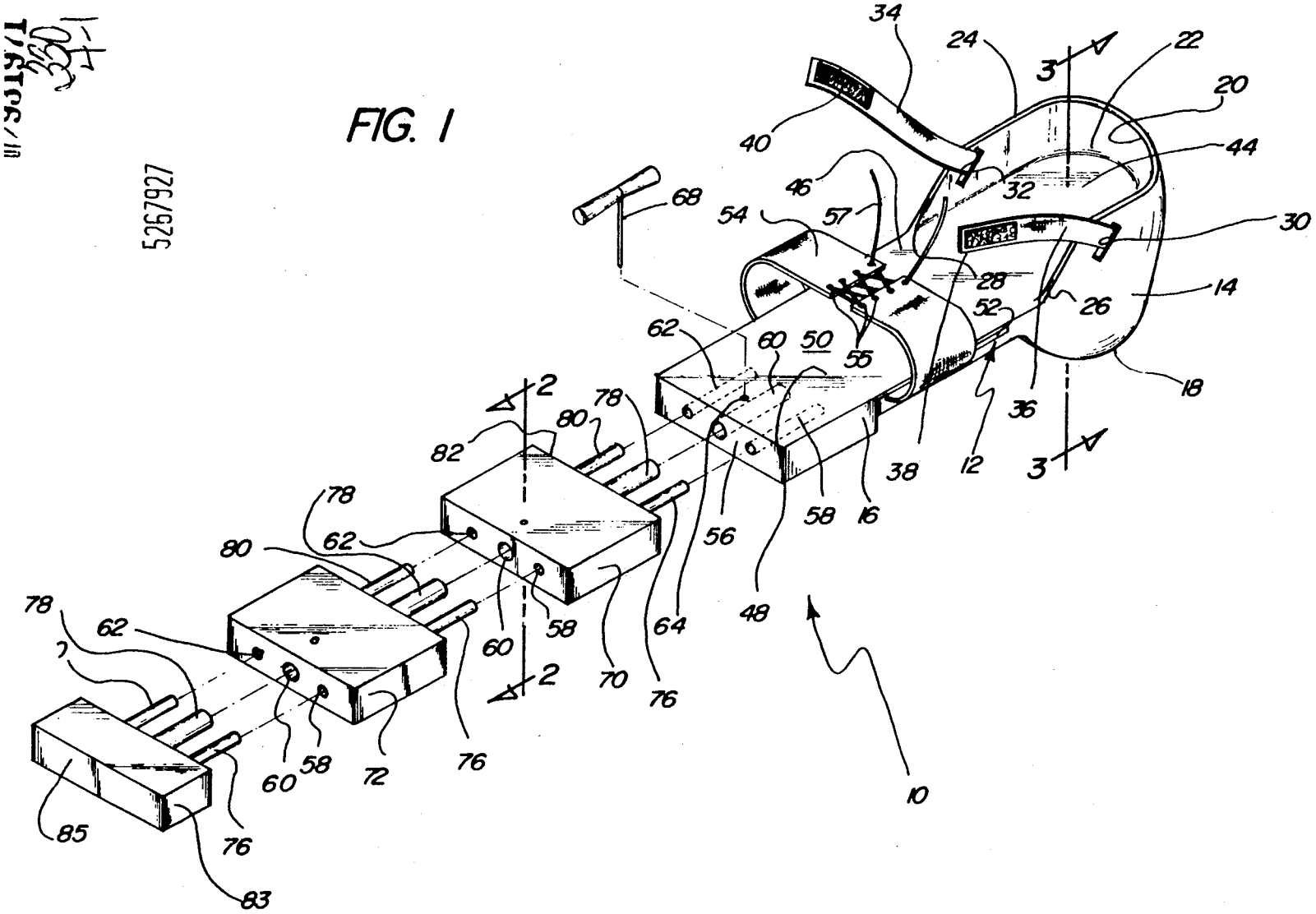
FIG. 1 is a perspective assembly view showing the first preferred embodiment of the exercising device of the invention.
Figure 3:
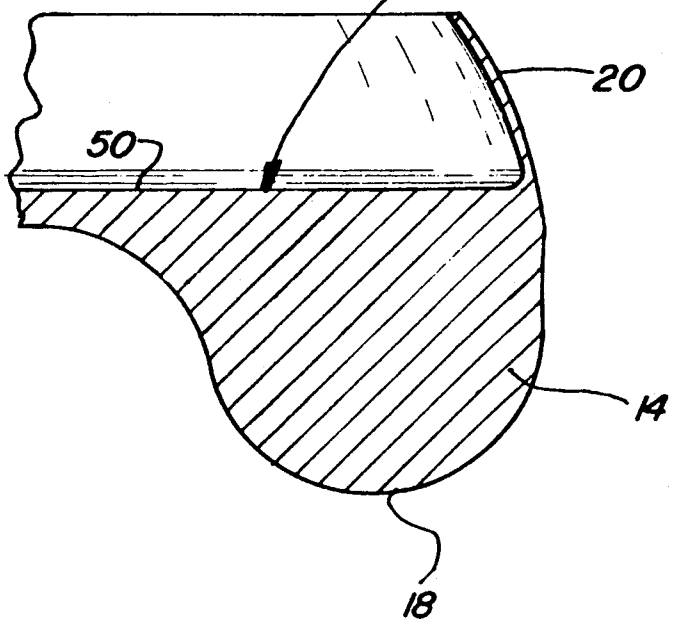
FIG. 3 is a cross-sectional view of the exercising device of FIG. 1 taken along line 3—3 thereof.
Figure 2:
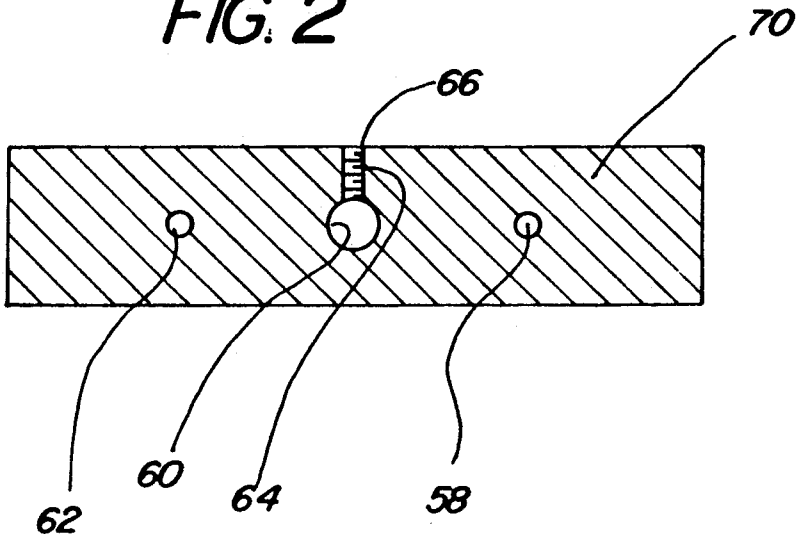
FIG. 2 is a cross-sectional elevational view of the exercising device taken along line 2—2 of FIG. 1.

Turning initially to FIGS. 1-3, there is shown a first exemplary embodiment of the exercising device of the invention generally designated by reference numeral 10. In its preferred form, exercising device 10 comprises a shoe-like main portion generally represented by reference numeral 12 having a heel portion 14 and an integral generally rectangularly shaped sole portion 16 extending therefrom substantially as shown. Heel portion 14 has a spherical or rounded lower portion 18 suitably shaped and sized to permit the main portion 12 to rock in virtually any direction when the exercise device of the invention is worn on the foot of an individual in a weight bearing manner as will be further explained below.

Extending upwardly from the rounded lower heel portion is an arcuately shaped sidewall 20 which extends laterally in a generally semi-circular manner about the similarly shaped rightmost portion 22 of sole portion 16. Sidewall 20 terminates in an upper edge 24 and a pair of opposed, angled side edges 26, 28 substantially as depicted. Sidewall 20 further includes a pair of opposed slots 30, 32 for anchoring a corresponding pair of fastening straps 34, 36 each of which preferably is in the form of a flexible web of suitable material. Preferably, one end of each strap is passed through a corresponding slot 30, 32 to form a loop and sewn together to secure the strap to the sidewall. The straps are of a length so that when the foot of an individual is received in the exercise device of the invention with the individuals heel snugly received within the cup formed by arcuate sidewall 20, the strap fasteners may be brought around the front of the ankle, overlapped and fastened in place. To facilitate this arrangement, the extremity of each strap suitably has attached thereto a corresponding fastener element 38, 40 preferably in the form of a mating fabric material as sold under the Registered trademark VELCRO, for example, with element 38 being sewn or otherwise affixed to bottom surface of strap 34, and element 40 being similarly affixed to the top surface of element 36 so that when the straps are overlapped and brought together they will engage in a secure mating relationship.

In order to provide more comfort to the wearer of the device, opposed portions of arcuate sidewall 20 proximal to slots 30, 32 may be dished outwardly to form a pair of inwardly confronting concavities or recess suitably sized to accommodate the medial and lateral malleoli (i.e. protruding ankle bones) of the foot.

Figure 4:
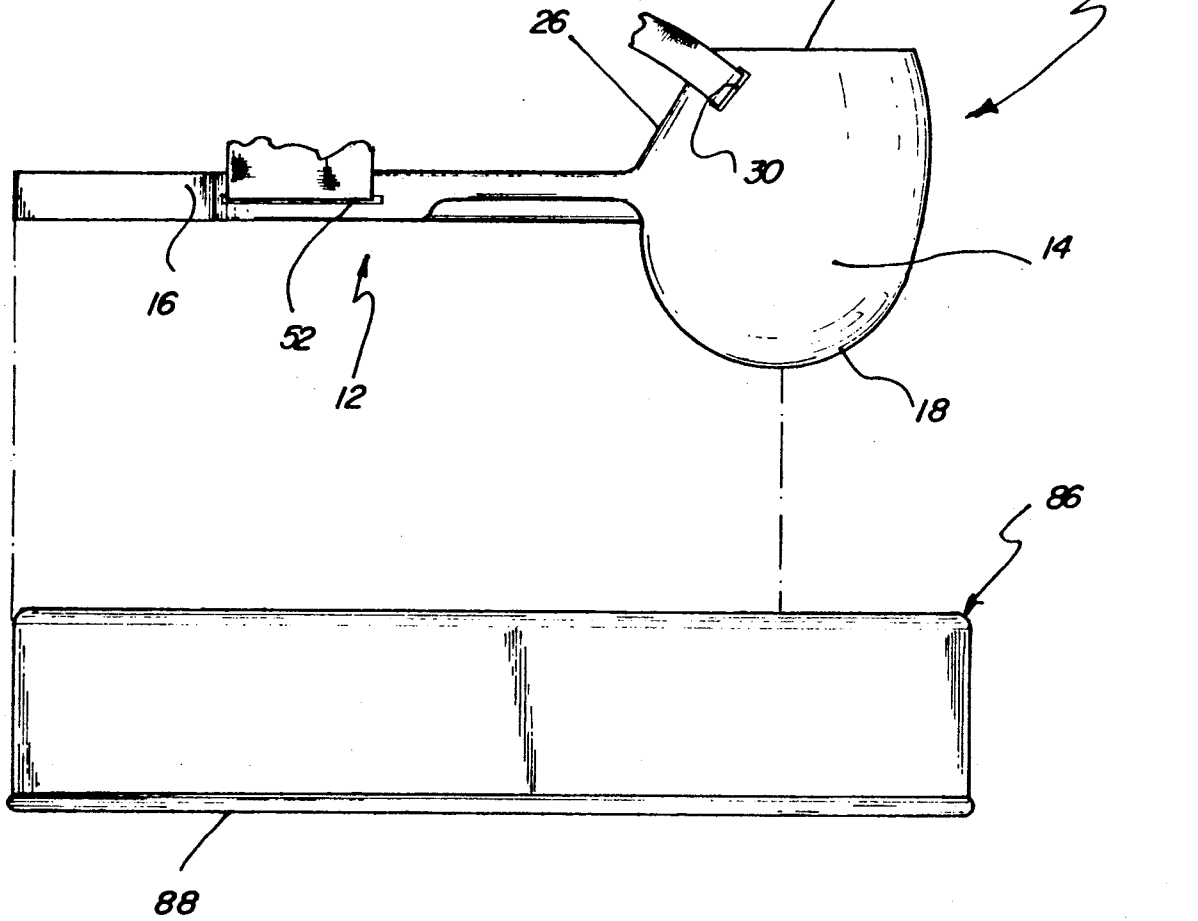
FIG. 4 is a front view in elevation of a second preferred embodiment of the invention.

The sole portion 16 of the exercise device of the invention generally comprises three longitudinally or axially arranged sections comprising respectively a heel section 44, an intermediate section 46 and a distal section 48 with the sections commonly defining a flat upper base surface 50 substantially as shown. The sole portion 16 is suitably sized to serve comfortably as a support for the foot of an individual when device 10 is worn, i.e. with the individual's heel resting on section 44, the individual's arch confronting section 46, and the individual's distal foot portion comprising the ball of the foot and the toes resting on section 48. As best seen in FIG. 4, section 46 includes a transverse through slot or passage 52 through which an instep fastener strap 54 extends substantially as shown. In its preferred form, fastener strap 54 is wider than straps 34, 36 and has a row of conventional eyelets or grommets 55 proximal to each extremity thereof such that a suitable shoe lace 57 may be threaded in conventional fashion through the grommets and tied together after the device has been fitted to the foot of an individual. With this arrangement, the instep fastener strap 54 and ankle fastener straps 34, 36 provide comfortable securement means for maintaining the exercise device on the foot of an individual during use.

In accordance with the invention, distal section 48 comprises a generally rectangular block of suitably weighted material so as to provide resistance during use of exercise device 10. The preferred material is aluminum, but other materials may be used instead. For example, device 10 alternatively may be fabricated of a durable molded polymeric material having metallic weights or inserts therein. Suffice it to say, the "weight" portion of device 10 is substantially concentrated in distal section 48 so that during exercise, a moment arm exits extending longitudinally from section 48 to heel section 44 and acts to load the foot sufficiently to work the various muscle groups and other soft tissue in the region of the foot, ankle, lower leg, upper leg and hips.

As best seen in FIG. 1, the distal section 48 terminates in an orthogonal, substantially flat front edge 56 having a series of parallel, spaced blind holes 58, 60, 62 therein extending perpendicular to edge 56. Hole 60, which is flanked by holes 58, 62 is preferably of larger diameter than the latter and intercepts a threaded recess 64 extending parallel to edge 56 and opening into top surface 50. A male threaded set screw 66 is threadedly engaged in recess 64 and is adapted to engage a dowel pin received in blind hole 60 as will soon be made more evident. A suitable driver tool 68 preferably is provided to tighten set screw 66.

In accordance with another important feature of the invention, a series of auxiliary weight blocks 70, 72, are provided for selectively adding weight to the exercise device 10. Weight blocks or modules 70, 72 are identical and each is sized and shaped substantially the same as distal section 48. In addition, each block 70, 72 has the same series of blind holes 58, 60, 62, and threaded recess and set screw 66 as distal section 66. In fact, the only difference between blocks 70, 72 and distal section 48 is a series of dowel pins 76, 78, and 80 extending from the rightmost edge 82 of blocks 70, 72 as viewed in FIG. 1. Dowel pins 76, 78, and 80 are sized to be slidably fitted within blind holes 58, 60, and 62, respectively so that the blocks form modular "add on" sections to section 48 of exercise device 10. Thus, if an individual wished to add weight to the device 10, one or more of the blocks 70, 72 are attached to the section 48 or to each other by interfitting the dowel pins in their corresponding blind holes and tightening down the corresponding set screw 66 with driver tool 68 as will occur to those of ordinary skill. Similarly, one or more modular blocks 70, 72 may be removed by loosening the set screw and withdrawing the block leftwardly as viewed in FIG. 1. Each modular block is adapted to add a predetermined amount of the same weight to device 10, say for example, one-half pound (i.e. each weighs the same). An end block 83 of smaller size and weight, say one-quarter pound, may optionally be provided. Alternatively, modular blocks (not shown) of the same size, shape and weight as end block 83 may be provided with the series of blind holes 58, 60, 62 in its end face 85 as this will increase the flexibility of adding weight in more discrete increments than would otherwise be the case if only the large (heavier) modular weight blocks are provided. In any event, it will be appreciated that any number of weight modules of either type and of any convenient weight may be provided, although from a practical standpoint the number of modules connected together axially and thence to distal portion 48 will be limited by the ability of the individual to perform weight lifting exercises without sustaining undue strain or injury.

From the above description, the use of exercise device 10 should be self-evident. The device is fitted to the foot of an individual and fastened in place by engaging the instep fastener strap 54 and ankle fastener straps 34, 36. A program of exercising may then be commenced by rocking the foot in dorsi-flexion and planto-flexion, or in eversion or inversion, by bearing weight on the rounded heel portion 14 of the device. Such exercises are especially suitable for training or rehabilitating the dorsal flexor muscles and alleviating or preventing a condition known as "shin splints". Additional exercises may be effected by elevating the foot while in the seated position, resting it on a small stool, and using the same movements in whatever pattern or combination of repetitions is desired. If and when an individual exercising program calls for progressive weight management, modular blocks 70, 72, and/or end block 83 made be selectively attached to device 10 in whatever combination or sequence is desired by first affixing a module to distal end portion 48 and if required, affixing additional modules to the first module in an axially nesting arrangement as substantially illustrated in FIG. 1. It is thus apparent that the exercising device of the present invention is capable of being used in a wide variety of body and leg positions and with more or less weight as dictated by individual requirements.

Figure 5:
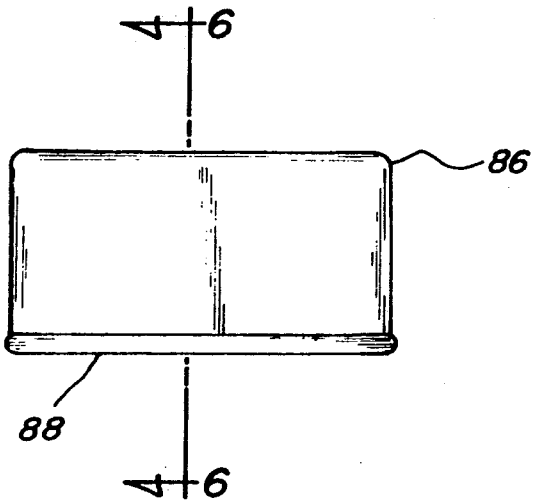
FIG. 5 is a side view in elevation of the second preferred embodiment of the invention.
Figure 6:
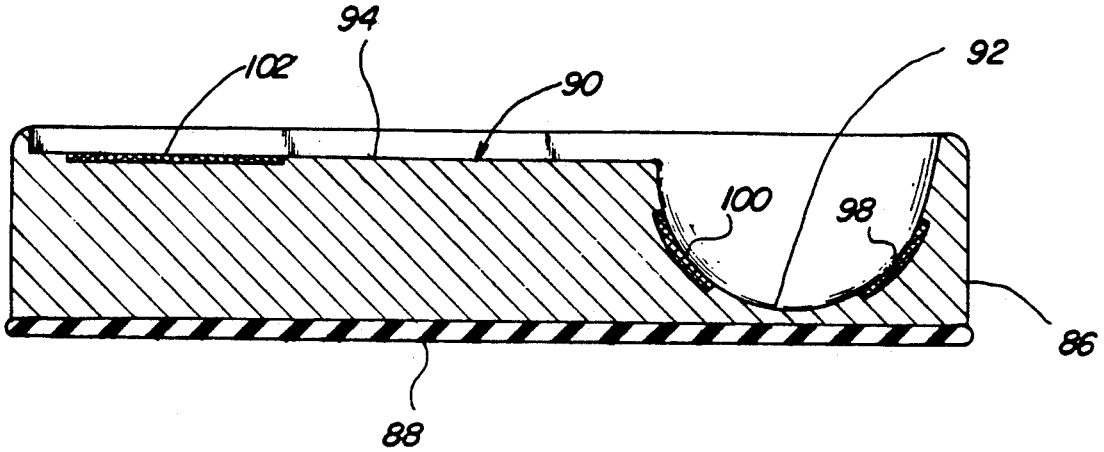
FIG. 6 is a cross-sectional view of the alternative embodiment of FIG. 5 taken along line 6—6 thereof.
Figure 7:
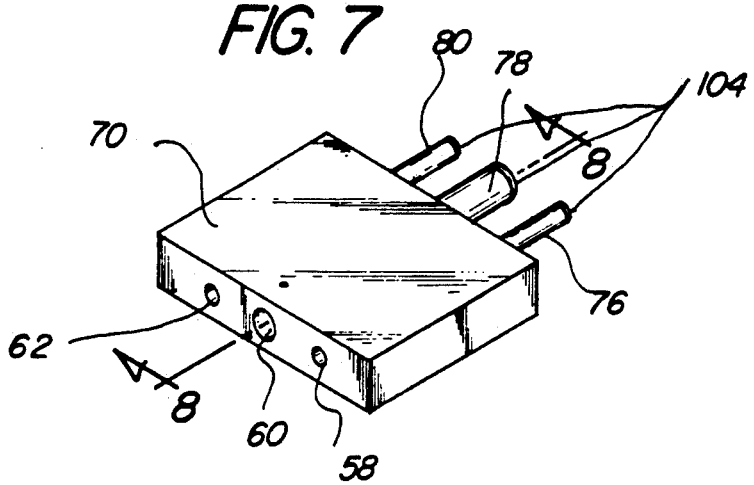
FIG. 7 is a perspective view in elevation of a portion of the second preferred embodiment of the invention.

Turning now to FIGS. 4–8, an alternative embodiment of the invention will be described wherein like reference numerals represent like parts. In order to provide the capability of engaging in exercises which do not require rocking movements of the foot employing the rounded heel portion as a fulcrum, or to facilitate ambulation without removing the exercise device from the foot, an adaptor module 86 is contemplated. As shown in FIGS. 4–6, adaptor module 86 comprises a generally rectangularly shaped tray or basket having a bottom, flat support surface 88, and an upwardly facing surface 90 shaped to conform to the shape of the underside of exercise device 10. Thus, as best seen in FIG. 6, adaptor 86 has a spherical recess 92 adapted to receive the rounded heel portion 14 of device 10, and a rectangular recess 94 adapted to receive the sole portion 16 of device 10.

In accordance with the alternative embodiment, means are provided for securing the exercise device to the adaptor when the former is nested within the latter. Such means in their preferred form comprises a pair of magnetic elements 98, 100 embedded in a flush manner in the surface of spherical recess 92, and a magnetic element 102 embedded in a flush manner in the surface of rectangular recess 94. Magnetic elements 98, 100, and 102 are adapted to interact with metallic inserts (not shown) suitably embedded in the spherical heel portion 14 and in the sole portion 16, respectively, of exercise device 10. By this arrangement, the exercise device 10 is adapted to be fastened to the adaptor 94 in a nesting manner thereby functionally providing the exercise device with benefit of the flat supporting surface 88 and in effect, nullifying the "rocking" effect of the rounded heel portion 14.

Figure 8:
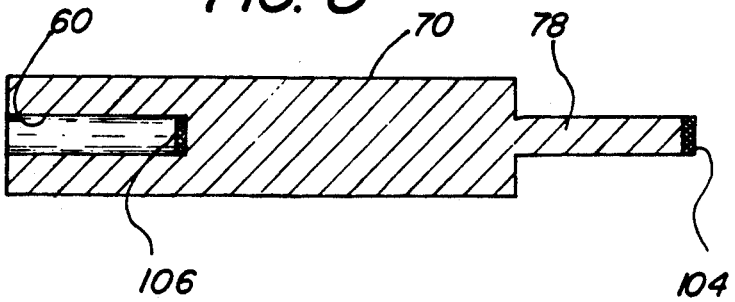
FIG. 8 is a cross-sectional view in elevation of a portion of the second preferred embodiment of the invention taken along line 8—8 of FIG. 7.

Similar magnetic means may be used to provide an alternative mode of fastening the weight modules to each other and/or to the exercise device 10. Hence, as shown in FIGS. 8 and 9, each of the large dowel pins may be provided with a distal tip portion 104 comprising a permanent magnet whereas the floor or end wall of each blind hole has suitably affixed therein a metallic plug 106 adapted to be attractively engaged by permanent magnet comprising distal tip portion 104. This alternative arrangement has the advantage of convenience as the parts may be inserted into each other and locked together without need of using the driver tool 68 to tighten the set screws 66.

It is apparent from the above that the present invention accomplishes all of the objectives set forth by providing a new and improved exercising device that is low in cost, relatively simple in design and operation, and which may advantageously be used to facilitate individually programmed exercising of the muscles or soft tissues of the lower extremities, knees, thighs, hips, stomach, and so on. The term "lower extremity" as used herein and in the appended claims should be broadly construed to mean the foot, ankle, or lower leg, individually or collectively, or any portions thereof.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved exercising device adapted to be worn on the lower extremity of an individual comprising:

a substantially flat, continuous base portion adapted to support the foot of the individual, said substantially flat continuous base portion having a first section for supporting the heel of the individual's foot, a second section for supporting the toes and ball of the individual's foot, and a third section intermediate said first and said second section in axial alignment therewith such that said second section has a free end defining the distal end of said base portion, said distal end defining a joinder surface extending orthogonally with respect the aligned axis of said first, second and third sections, fastener means adapted to affix said base portion to the foot of the individual, and adjustable weight means adapted to be removably joined to said distal end of said base portion, wherein said adjustable weight means comprises at least one weight module, said module having first joinder means thereon adapted to engage second joinder means on said joinder surface on said distal end of said base portion, said adjustable weight means having substantially the same shape as said second section whereby said adjustable weight serves as a weighted axial extension of said base portion.

2. The invention of claim 1 wherein said adjustable weight means comprises a multiplicity of weight modules, each of said modules having a pair of opposed ends, one of said opposed ends having said first joinder means thereon and the other of said opposed ends having said second joinder means thereon whereby said modules may selectively and removably be connected to each other and to said distal end of said base portion.

3. The invention of claim 2 wherein said first section for supporting the heel of the individual's foot comprises a rounded portion extending from said base portion.

4. The invention of claim 2 wherein said fastener means comprises first strap means joined to said first section and adapted to engage the ankle of the individual's foot and second strap means joined to said second section and adapted to engage the instep of the individual's foot.

5. The invention of claim 1 wherein said first section for supporting the heel of the individual's foot comprises a rounded portion extending from said base portion, further including adaptor means for rendering said rounded portion flat.

6. The invention of claim 5 wherein said adaptor means comprises a rectangularly shaped basket having a flat bottom supporting surface and an upper surface shaped to receive said base portion sections including said rounded portion extending from said first section in a nesting relationship, and means for fastening said base portion and said basket together.

7. The invention of claim 6 wherein said means for fastening said base portion and said basket together comprises metallic means embedded in said base portion, and magnetic means embedded in said upper surface of said basket.

8. The invention of claim 2 wherein said second joinder means comprises at least one dowel extending from said module and said first joinder means comprises a recess adapted to receive said dowel and means for locking said dowel in said recess.

9. The invention of claim 8 wherein said locking means comprises a threaded passage intercepting said recess, and screw means in said passage adapted to engage said dowel.

10. The invention of claim 8 wherein said locking means comprises a magnetic element affixed to the end of said dowel and metallic means adapted to be attractively engaged by said magnetic element in said recess.

* * * * *